US007194790B2

(12) United States Patent
Leger

(10) Patent No.: US 7,194,790 B2
(45) Date of Patent: Mar. 27, 2007

(54) NEEDLE LOOM

(75) Inventor: Joachim Leger, Eberbach (DE)

(73) Assignee: Oskar Dilo Maschinenfabrik KG, Eberbach (DE)

( * ) Notice: Subject to any disclaimer, the term of this patent is extended or adjusted under 35 U.S.C. 154(b) by 0 days.

(21) Appl. No.: 11/216,196

(22) Filed: Aug. 31, 2005

(65) Prior Publication Data

US 2006/0048356 A1 Mar. 9, 2006

(30) Foreign Application Priority Data

Sep. 8, 2004 (DE) ..... 10 2004 043 890

(51) Int. Cl.
*D04H 18/00* (2006.01)

(52) U.S. Cl. ..... 28/114; 28/107

(58) Field of Classification Search ..... 28/107, 28/114, 110, 111, 113, 115, 109, 108, 112; 112/80.4, 80.42, 80.41, 80.43, 80.45
See application file for complete search history.

(56) References Cited

U.S. PATENT DOCUMENTS 4,891,870 A 1/1990 Müller
5,732,453 A 3/1998 Dilo
5,873,152 A * 2/1999 Jourde et al. ..... 28/107
6,161,269 A 12/2000 Dilo
6,305,058 B1 * 10/2001 Fehrer ..... 28/107
6,481,071 B1 * 11/2002 Fehrer et al. ..... 28/107
6,568,051 B2 * 5/2003 Legl et al. ..... 28/114
6,622,359 B2 * 9/2003 Legl ..... 28/114
6,735,837 B2 * 5/2004 Pum ..... 28/114
6,748,633 B2 * 6/2004 Legl et al. ..... 28/114
6,785,940 B1 * 9/2004 Muller ..... 28/114

* cited by examiner

*Primary Examiner*—Amy B. Vanatta
(74) *Attorney, Agent, or Firm*—Jansson Shupe & Munger Ltd.

(57) ABSTRACT

In a needle loom having at least one needle bar coupled by cam follower means to two eccentric shafts in order to be moved by said eccentric shafts in a movement path having two components which are normal to one another, the eccentric shafts are each provided with eccentric cams which have equal amounts of eccentricity and are adapted to be synchronously rotated, and said cam followers rotatably mounted on said eccentric cams are movably connected to one another by at least one coupling element which is adapted to yield in one direction but is stiff in a direction normal thereto.

25 Claims, 9 Drawing Sheets

NEEDLE LOOM

FIELD OF THE INVENTION

The present invention relates to a needle loom having at least one needle bar which is coupled to two eccentric drives to be conferred thereby in a movement having two components which are normal to one another. A needle loom of this kind is known from U.S. Pat. No. 5,732,453.

STATE OF THE ART

When needling a fiber web in a needle loom in which the needle bar performs a movement merely in a direction which is normal to the fiber web to be needled, the fiber web continuously transported through needle loom by supply and withdrawal rollers of the needle loom is temporarily stopped in its movement during those time periods of the needling cycles in which it is penetrated by the needles supported at the needle bar. Therefrom results some drawing within the fiber web and some resilient bending of the needles. These effects are disadvantageous for both the fiber web and the needle loom. They also limit the productivity of the needle loom, as they impose severe restrictions onto the transport rate of the fiber web per needle punch.

To remedy these drawbacks, it is known from U.S. Pat. No. 5,732,453 mentioned above to provide the needle loom with a second drive means associated to the needle bar by which the latter in synchronism with the stitching movement normal to the fiber web, called vertical movement, is cyclically driven in a swinging movement directed in parallel to the fiber web, i.e. in a horizontal direction. This driving principle is shown in FIG. 9 of the accompanying drawings. The horizontal movement created by the second drive means extends in and against the transport direction of the fiber web within the needle loom and is matched to the stitching movement of the needle bar in a manner, that the movement of the needle bar in the horizontal direction within the time period of each cycle of needle bar movement, in which the needles are stitched in the fiber web, follows the transportation of the fiber web caused by the supply and withdrawal rollers, whereas in those time periods in which the needles are removed from the fiber web, a horizontal movement of the needle bar into the starting position takes place. Thus, the superposition of the vertical and horizontal movement components of the needle bar results in a movement pattern which, seen transversely to the transport direction of the fiber web, is more or less circular, depending of the ratio of the strokes of the vertical and horizontal movement components.

From U.S. Pat. No. 6,161,269, a needle loom operated in the above manner is known in which the horizontal movement component of the needle bar is generated by two rotating shafts having each an eccentric cam onto which a respective conrod is rotatably supported. The conrods of both drives are articulated to a common coupling bar which in turn is articulated to the needle bar. By adjusting the mutual phase angle of revolution of said eccentric cams, the stroke of the horizontal movement component of the needle bar may be adjusted between zero and a maximum value, without any need to stop the operation of the needle loom.

SUMMARY OF THE INVENTION

In many fields of application, it is not necessary that the stroke of the horizontal movement component of the needle bar is variable with respect to the stroke of the vertical movement component, so that respective measures for the variation of the stroke of the horizontal movement component may be dispensed with. However, when needling fiber webs of very low weight per unit area which requires a needling process in a large number of steps performed in a plurality of needle looms arranged in a line, needle looms are required which on the one hand operate in accordance with the principle explained above, i.e. include a horizontal movement component, and on the other hand are of a simple design to enable an economic construction of such needle loom line. It is the object of the invention to provide a needle loom of this kind.

In accordance with the present invention, a needle loom is provided having at least one needle bar coupled by cam and follower means to two eccentric shafts in order to be moved by a rotation of said eccentric shafts in a movement path having two components which are normal to one another, wherein said eccentric shafts are each provided with eccentric cams which have equal amounts of eccentricity and equal angular positions of rotation and are adapted to be synchronously rotated, and cam followers each rotatably mounted on said eccentric cams are movably connected to one another by at least one coupling element.

In a preferred embodiment of the invention, the coupling of said cam followers is established by at least one linking rod. Alternatively, the coupling of said cam followers may be established by resilient metal spring means.

According to another aspect of the invention, a needle loom is provided having two eccentric shafts rotatably mounted in a common height level in a machine stand, said eccentric shafts having eccentric cams, on each of which a cam follower is rotatably mounted which supports a needle bar, wherein the coupling element is adapted to yield in a direction only which is normal to the eccentric shafts and is within a plane defined by said eccentric shafts, whereas the coupling element is stiff in a direction which is normal to said plane.

According to a further aspect of the invention, a needle loom is provided having two eccentric shafts rotatably mounted in a common height level in a machine stand, said eccentric shafts having eccentric cams, on each of which a cam follower is rotatably mounted which supports a needle bar, wherein the cam followers are connected to one another by means of two coupling elements, which are each fixed to both cam followers and are arranged so as to cross one another. The coupling elements may be disposed in an angle of 90° with respect to one another. Further, the coupling elements may be rigidly connected to said cam followers and be flexible.

In a preferred embodiment, the coupling elements are fixed to extensions formed at said cam followers, said extensions extending opposite to the needle bars with respect to the eccentric shafts.

According to a further aspect of the invention, a needle loom is provided having two eccentric shafts rotatably mounted in same height levels in a machine stand, said eccentric shafts having eccentric cams, on each of which a cam follower is rotatably mounted which supports a needle bar, wherein the coupling element is a pin which is received by bores formed each in an extension of each cam follower, said extensions extending opposite to the needle bars with respect to the eccentric shafts.

In another preferred embodiment, in a needle loom having two eccentric shafts rotatably mounted in same height levels in a machine stand, said eccentric shafts having eccentric cams, on each of which a cam follower is rotatably mounted, said cam followers extend in an acute angle with one another forming an apex and are integrally united in the region of said apex and support at least one needle bar within said region, the coupling element being disposed in one of said cam followers between its associated eccentric shaft and said region where the cam followers are integrally united. The coupling element may be formed by a metal spring means, which is stiff in longitudinal direction of its cam follower.

In many fields of application, it is not necessary that the stroke of the horizontal movement component of the needle bar is variable with respect to the stroke of the vertical movement component, so that respective measures for the variation of the stroke of the horizontal movement component may be dispensed with. However, when needling fiber webs of very low weight per unit area which requires a needling process in a large number of steps performed in a plurality of needle looms arranged in a line, needle looms are required which on the one hand operate in accordance with the principle explained above, i.e. include a horizontal movement component, and on the other hand are of a simple design to enable an economic construction of such needle loom line. It is the object of the invention to provide a needle loom of this kind.

In accordance with the present invention, a needle loom is provided having at least one needle bar coupled by cam and follower means to two eccentric shafts in order to be moved by a rotation of said eccentric shafts in a movement path having two components which are normal to one another, wherein said eccentric shafts are each provided with eccentric cams which have equal amounts of eccentricity and equal angular positions of rotation and are adapted to be synchronously rotated, and cam followers each rotatably mounted on said eccentric cams are movably connected to one another by at least one coupling element.

In a preferred embodiment of the invention, the coupling of said cam followers is established by at least one linking rod. Alternatively, the coupling of said cam followers may be established by resilient metal spring means.

According to another aspect of the invention, a needle loom is provided having two eccentric shafts rotatably mounted in a common height level in a machine stand, said eccentric shafts having eccentric cams, on each of which a cam follower is rotatably mounted which supports a needle bar, wherein the coupling element is adapted to yield in a direction only which is normal to the eccentric shafts and is within a plane defined by said eccentric shafts, whereas the coupling element is stiff in a direction which is normal to said plane.

According to a further aspect of the invention, a needle loom is provided having two eccentric shafts rotatably mounted in a common height level in a machine stand, said eccentric shafts having eccentric cams, on each of which a cam follower is rotatably mounted which supports a needle bar, wherein the cam followers are connected to one another by means of two coupling elements, which are each fixed to both cam followers and are arranged so as to cross one another. The coupling elements may be disposed in an angle of 90° with respect to one another. Further, the coupling elements may be rigidly connected to said cam followers and be flexible.

In a preferred embodiment, the coupling elements are fixed to extensions formed at said cam followers, said extensions extending opposite to the needle bars with respect to the eccentric shafts.

According to a further aspect of the invention, a needle loom is provided having two eccentric shafts rotatably mounted in same height levels in a machine stand, said eccentric shafts having eccentric cams, on each of which a cam follower is rotatably mounted which supports a needle bar, wherein the coupling element is a pin which is received by bores formed each in an extension of each cam follower, said extensions extending opposite to the needle bars with respect to the eccentric shafts.

In another preferred embodiment, in a needle loom having two eccentric shafts rotatably mounted in same height levels in a machine stand, said eccentric shafts having eccentric cams, on each of which a cam follower is rotatably mounted, said cam followers extend in an acute angle with one another forming an apex and are integrally united in the region of said apex and support at least one needle bar within said region, the coupling element being disposed in one of said cam followers between its associated eccentric shaft and said region where the cam followers are integrally united. The coupling element may be formed by a metal spring means, which is stiff in longitudinal direction of its cam follower.

BENEFITS OF THE INVENTION

By the present invention, use of eccentric twin drives as usual in needle looms for driving the needle bar in the vertical stitching direction is possible, see e.g. U.S. Pat. No. 6,161,269 above, wherein two eccentric drives are disposed in the head of a machine stand and usually move two needle bars integrally united as a twin up and down, said movement being effected via respective conrods driven in synchronism by the respective eccentric drives. However, unlike the prior art where the eccentric drives are rotated in mutually opposite directions in view of a balance of moving masses, the needle loom of the present invention requires a synchronous rotation of the eccentric drives in equal directions, as the horizontal movement component of the needle bar is generated by the same rotating eccentric shafts creating the vertical movement component of the needle bars. As the masses driven by the shafts of the eccentric drives perform a movement which is congruent with the movement of the eccentric cams of the rotating shafts, a balance of first order only of the flyweight is necessary. This balance may be attained in a simple manner by arranging balancing weights on each one of the rotating eccentric shafts in an angular position which is offset by 180° from the respective eccentric cams.

In principle, if any bearing clearance, any eccentricities in the bearings of the eccentric shafts of the eccentric drives, or any tolerances in the synchronism of the rotation of said shafts are neglected, it were possible to rigidly connect the conrods or cam followers with one another, whereby a parallel guidance of both cam followers is attained so that in operation, both needle bars perform a movement which exactly equals the movement of the eccentric cams. However, in practice, deficiencies like bearing clearances, minute eccentricities of the shafts, even if present in fractions of a millimeter only, and minute defects in the synchronism of the rotation of both driving shafts cannot be totally avoided, so that due to the so-called "dual fit" caused by the rigid connection of the cam followers, a jamming occurs which finally results in a destruction of the bearings. To avoid such jamming, according to the present invention the cam followers supported on the eccentric cams of the driving shafts are movably connected to one another, wherein the moveability preferably is effective in the direction only in which such jamming may occur, but not in the direction normal thereto, as the cam followers are able to yield in the latter direction.

The present invention provides a solution comprising few components and in principle avoids the need of a separate driving means to generate the horizontal movement component of the needle bar. This is evident if comparing the drawings of the present invention with those of U.S. Pat. No. 5,732,453. In the present invention, the articulated connection between the needle bar and the horizontal driving means needed in the known driving arrangements is avoided.

In the needle loom of the present invention, the stroke of the horizontal movement of the needle bar is predefined, resulting from the structure of the driving means. In operation of the needle loom, depending on the kind of fiber web processed in the needle loom, a change of the length of the fiber web results from the needling process. If a plurality of needle looms are arranged in a line and the fiber web is passed therethrough, such changes of fiber web length must be taken into consideration at the individual needle looms to avoid an upsetting or a drawing of the fiber web. This may be attained by individually adjusting the stitching frequencies of the individual needle looms in case that the strokes of movement of the needle bars are equal in the needle looms or by individually adjusting the height positions of stitching plates in said needle looms.

Further aspects of the invention may be seen from the following detailed description of the invention which is given with reference to the accompanying drawings.

DESCRIPTION OF THE DRAWINGS

The invention will now be explained in details with reference to the accompanying drawings, in which.

DETAILED DESCRIPTION OF PREFERRED EMBODIMENTS

Figure 1:
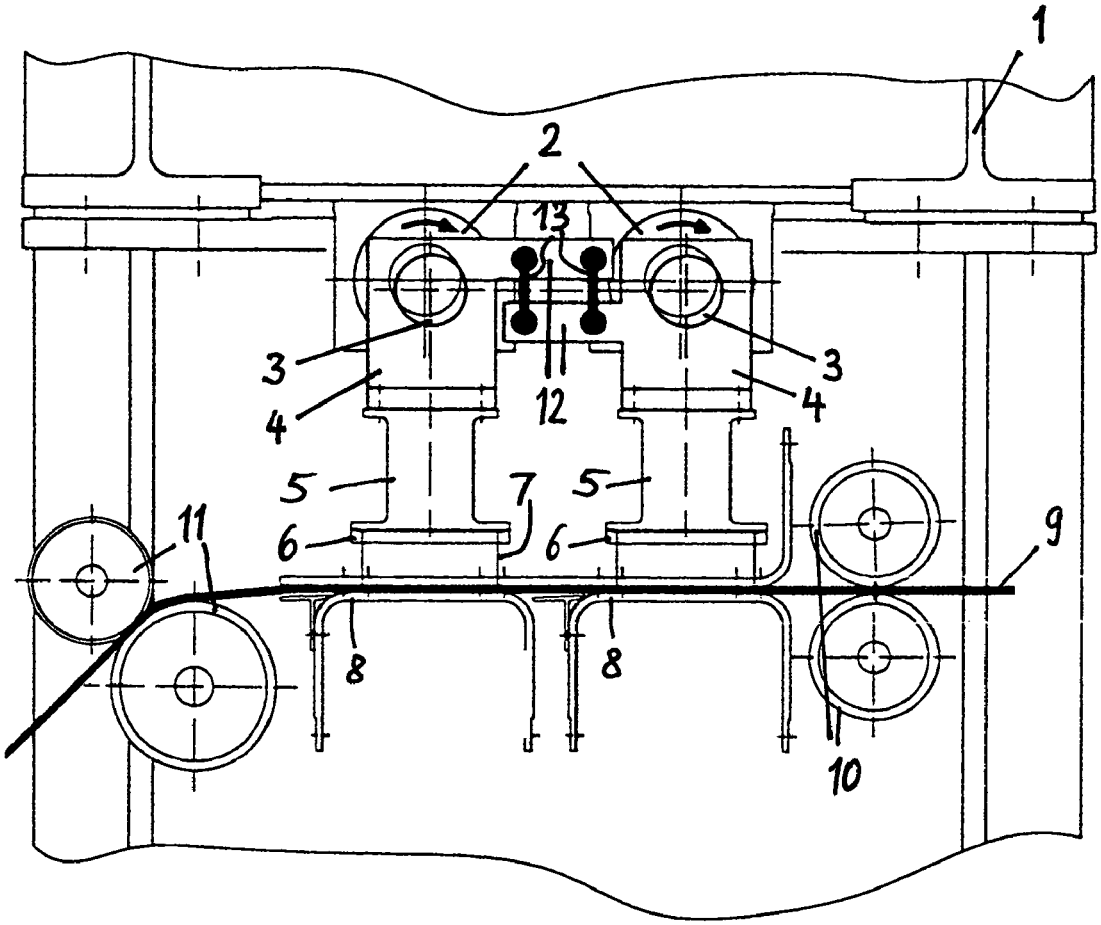
FIG. 1 is showing a first embodiment of the invention with a twin arrangement of rotating drive shafts each having an eccentric cam and a link arrangement serving as a coupling means.

In FIG. 1, a section of a needle loom including the features of the present invention is shown. Those portions of the needle loom which are not necessary for the explanation of the invention are omitted. According to FIG. 1, in the head portion a machine stand 1, two driving eccentric shafts 2 having eccentric cams 3 provided thereon are mounted for unison rotation in same directions of rotation in a common horizontal level. The drive means, e.g. an electric motor driving said eccentric shafts, is not shown. The eccentric cams 3 provided at the eccentric shafts 2 have equal amounts of eccentricity and equal angular positions, as shown in FIG. 1. On each eccentric cam 3, a machine element 4 formed as a metal plate and in the following called cam follower is rotatably mounted so that it may be moved in a circular path by a rotation of the eccentric cam 3. A needle bar 5 is affixed to each of said cam followers 4, the needle bars 5 supporting each a needle board 6 provided with a large number of needles 7, as is common in the respective art.

Below said needle bars 6, stitching plates 8 provided with needle entry openings are disposed in the machine stand 1, said stitching plates serving as supports of a fiber web 9 to be needled by the needle loom. Pairs of supply rollers 10 and withdrawal rollers 11 are rotatably mounted in the machine stand 1 on either side of a needling zone defined by the needle boards 6 and the stitching plates 8, said roller pairs being driven by respective driving means not shown to effect a transportation of the fiber web 9 through the needle loom in a transport direction which in the shown example is extending from the right to the left side.

Both cam followers 4 have a lateral, cantilever extension 12. Those extensions 12 extend one above the other and are linked to one another by coupling elements 13 which are articulated to said extensions. The coupling elements 13 extend normal to the stitching plates 8, i.e. in parallel to the stitching movement of the needles 7. They are stiff in their longitudinal directions. Thus, the coupling elements 13 allow a mutual movement of the cam followers 4 in the horizontal direction so that any jamming possibly appearing at the bearings of the eccentric shafts 2 and resulting from defects of the kind explained in the opening portion of this specification is prevented, whereas the orientation of the cam followers is maintained, keeping the needles 7 vertical.

In operation, upon rotation of the eccentric shafts 2, their eccentric cams 3 rotate with equal phase relation. By the linkage of the cam followers 4 via their extensions 12 and the coupling elements 13, the cam followers 4 follow the movement of the eccentric cams 3 in congruence, so that the tips of the needles 7 each perform a path of movement which is circular when seen in the plane of the instant drawing figure. In this path of movement, during the horizontal movement component of the eccentric cams directed to the left, the tips of the needles 7 are stitched in the fiber web 9 to be needled, so that the horizontal movement of the needles follows the transport movement of the fiber web 9 caused by the supply and withdrawal rollers 10 and 11, respectively. In contrast thereto, during the horizontal movement component directed to the right, the needles 7 are removed from the fiber web 9, so that the needles 7 are able to return into their initial position without affecting the transport movement of the fiber web 9. By adjusting the height position of the stitching plates 8, the length of the time period within which the needles 7 are stitched in the fiber web within each stitching cycle may be influenced.

In case that the eccentricities of the eccentric cams 3 are slightly different and/or the synchronism of their rotation is not exact and/or there are other defects, e.g. in the bearings of the eccentric shafts 2, the cam followers are able to yield in a horizontal direction due to the fact that they are not rigidly coupled to one another but are linked by the coupling elements 13 articulated to said cam followers 4. The general orientation of the cam followers 4 as shown in the drawing is maintained due to the stiff coupling of the lateral extensions 12 in a vertical direction. Thus, the needles 7 always penetrate in a vertical orientation into the fiber web 9, they do not tilt during their movement, at least not to a visible extent. Jamming at the eccentric shafts 2 is avoided by the linked coupling of the cam followers 4.

Figure 2:
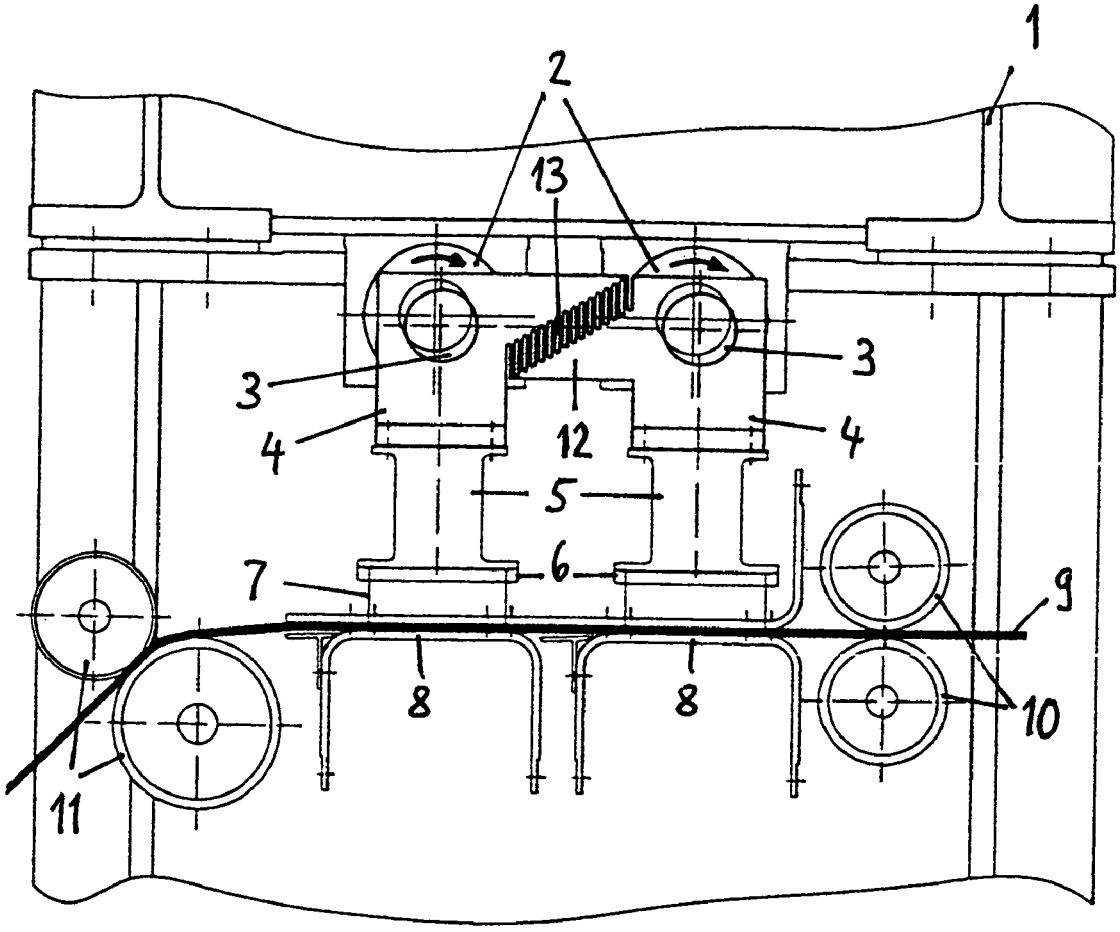
FIG. 2 is showing a second embodiment of the invention with a twin arrangement of rotating drive shafts each having an eccentric cam, a coupling means being formed by an integrated spring arrangement.

Referring to FIG. 2, a second embodiment of the invention is shown therein in which components which are comparable to those shown in FIG. 1 and explained above with reference thereto are provided with the same reference numerals. The embodiment shown in FIG. 2 essentially corresponds to that shown in FIG. 1 with the exception that the cam followers 4 are formed as an integral unit. The unit comprises a lateral extension 12 connecting both cam followers 4, said lateral extension 12 comprising a plurality of oblong slots extending in parallel through the said extension. The slots extend in vertical direction and are offset against one another in the vertical direction. The first and last slots are open at one of their ends. In view of the resiliency of the material forming the extension 12, the portions of the extension separated by the slanted line of parallel slots may be moved to a small extent with respect to one another in the horizontal direction, whereby the webs separating adjacent slots from one another are resiliently bent. Thus, the series of slots forms a coupling element 13 within the extension 12 which is resilient in the horizontal direction but is stiff in the vertical direction. By the effect of this coupling element 13, a jamming at the bearings of the eccentric shafts 2 is avoided even if there are structural deficiencies of the kind mentioned in connection with the other embodiments of the invention. Deficiencies effective in the vertical direction do not affect the bearings as the twin arrangement formed by the cam followers 4 is able to tilt to a sufficient extent due to the yielding coupling element 13. The slots forming the coupling element 13 may be formed by machining the metal plate from which the cam followers 4 is made.

Figure 3:
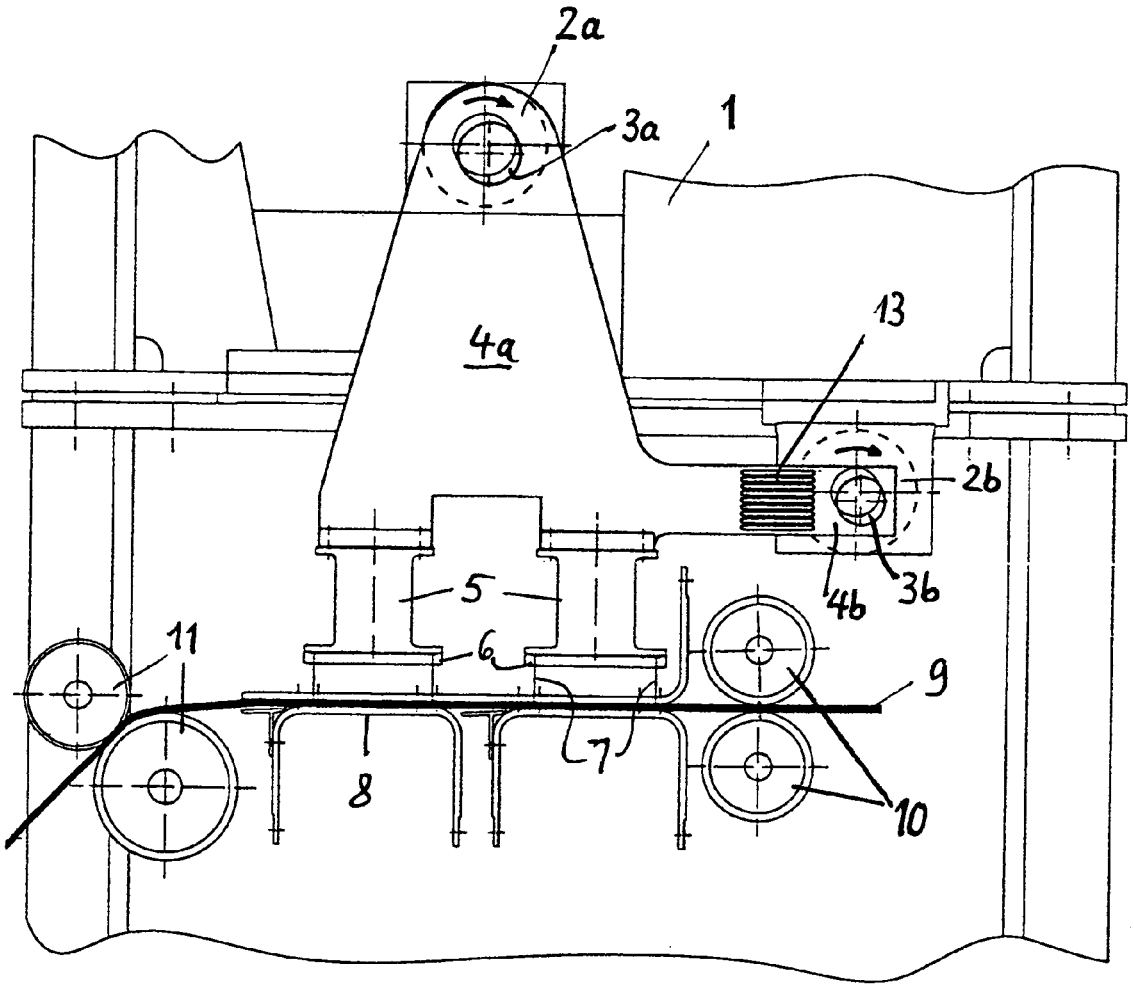
FIG. 3 is showing a third embodiment of the invention with two rotating drive shafts disposed separately from one another and each having an eccentric cam, a coupling means being formed by an integrated spring arrangement.

In FIG. 3, another embodiment of the invention is shown comprising a coupling element 13 of the kind shown in FIG. 2. In this embodiment of the invention, two eccentric shafts 2*a* and 2*b* are rotatably mounted in the machine stand 1 different levels and are laterally offset from one another. A cam follower 4*a* is rotatably mounted on an eccentric cam 3*a* of the eccentric shaft 2*a* disposed in the higher level, said cam follower 4*a* mounting two needle bars 5. On an eccentric cam 3*b* of the other eccentric shaft 2*a* rotatably mounted in the lower position within the machine stand 1, a cam follower 4*b* is rotatably mounted, said cam follower 4*b* being integrally connected to first-mentioned cam follower 4*a*.

Said cam followers 4*a* and 4*b* are integrally formed with one another as a metal plate, however, the portions 4*a* and 4*b* thereof are connected with one another by a coupling element 13 formed by a plurality of slots extending in parallel to one another in a horizontal direction. Thereby, cam follower 4*b* is resiliently displaceable with respect to cam follower 4*a* in vertical direction due to the resiliency of the metal material forming the webs between the parallel slots, whereas coupling element is stiff in the horizontal direction. The remainder of the structure shown in FIG. 3 is similar to those shown in FIGS. 1 and 2 and is symbolized by same reference numerals, so that a detailed description thereof may is omitted.

In operation, in the embodiment of FIG. 3, the eccentric cams 3*a* and 3*b* rotate in unison in equal phases. By the ability of cam follower 4*b* to displace with respect cam follower 4*a* in vertical direction, any deficiencies of the above explained kind are taken up by the coupling element 13, so that jamming at the bearings of the eccentric shafts 2*a* and 2*b* is avoided and the general orientation of the needle bars 5 is maintained.

Figure 4:
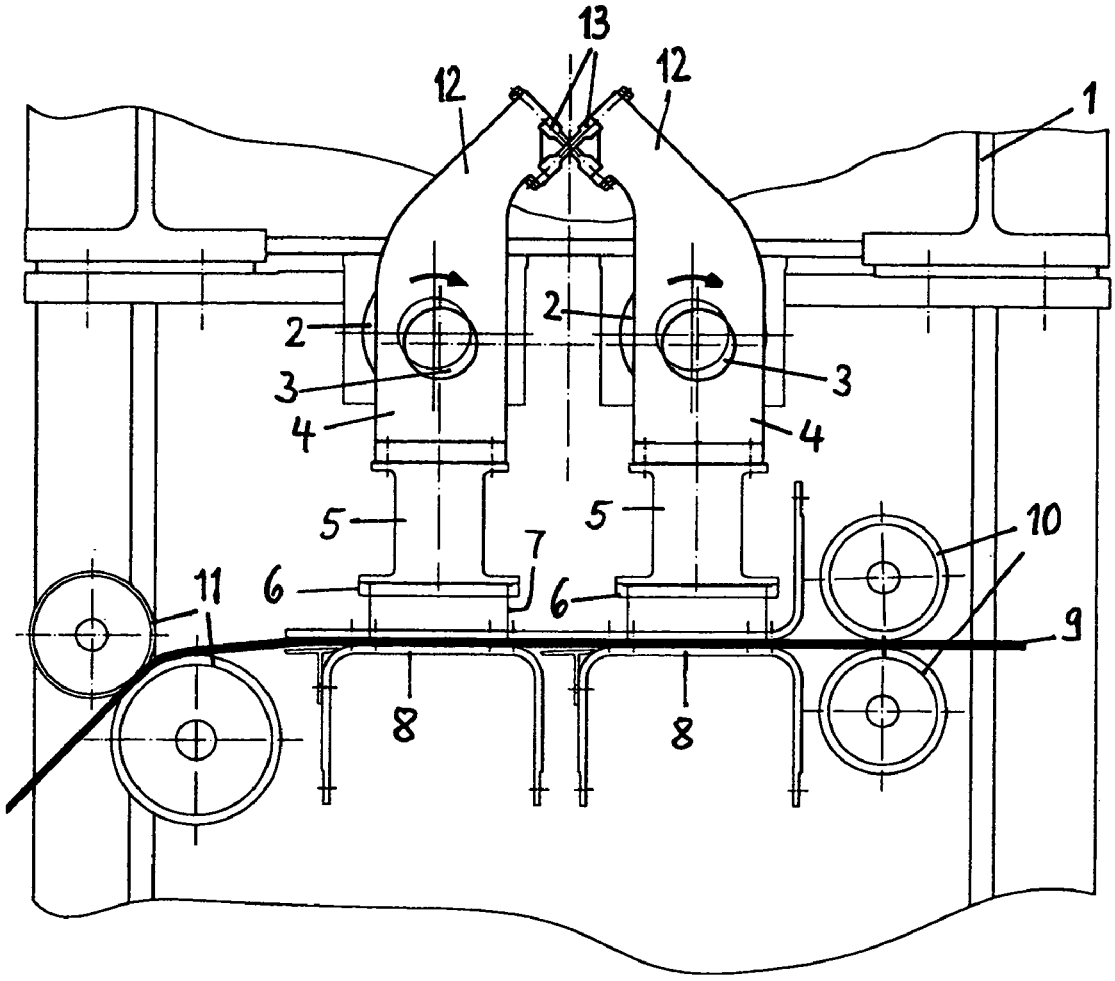
FIG. 4 is showing a fourth embodiment of the invention with a twin arrangement of rotating drive shafts each having an eccentric cam, a coupling means being formed by two links arranged crosswise.

In FIG. 4, a fourth embodiment of a needle loom of the invention is shown, said needle loom having two eccentric shafts 2 rotatably mounted in the same level in a machine stand 1. As in the other embodiments, the eccentric cams 3 of the eccentric shafts have equal amounts of eccentricity and have equal angular rotational positions. Cam followers 4 are rotatably mounted on said eccentric cams 3, each of said cam followers 4 mounting a needle bar 5. Each of the cam followers 4 comprises an extension 12 extending in a direction opposite to the needle bar. Those extensions 12 have upper portions which are symmetrically elbowed so as to extend in a right angle with respect to one another. The upper ends of said elbowed portions of the extensions 12 are connected with one another by two coupling elements 13 which cross one another. Those coupling elements 13 may be stiff, to be articulated to the upper ends of the elbowed portions of extensions 12, or they may flexible elements and be fixedly connected to said upper ends, as shown in the drawing. The other elements of the embodiment are similar to those shown in FIGS. 1 to 3, so that a detailed explanation may be dispensed with.

In view of the yielding connection of extensions 12 via said coupling elements 13, it is secured that the cam followers may displace with respect to one another in a limited extent which is sufficient to avoid jamming at the bearings of the rotating eccentric shafts 2, whereas the general orientation of the needle bars 5 is maintained.

Figure 5:
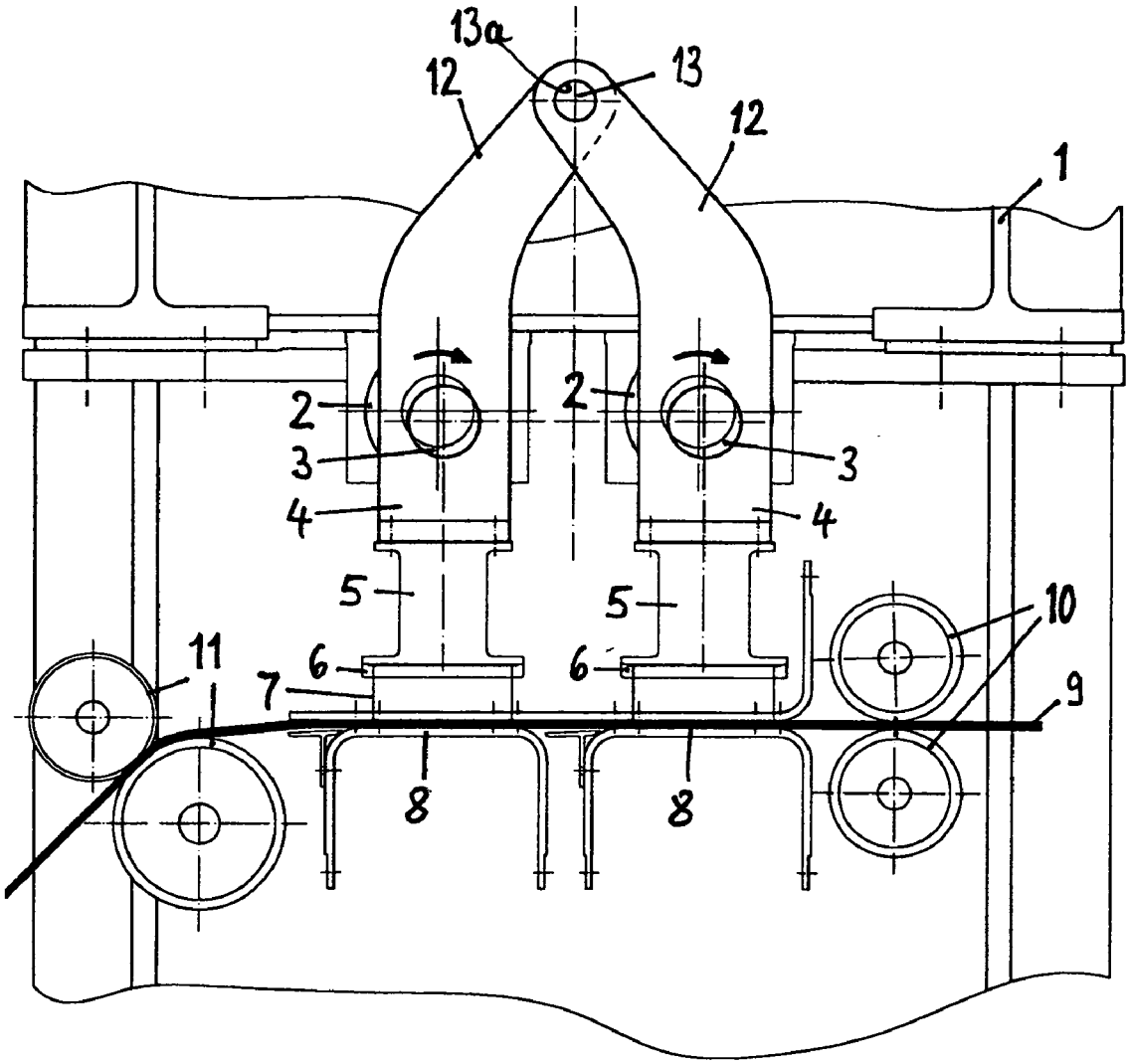
FIG. 5 is showing a fifth embodiment of the invention with a twin arrangement of rotating drive shafts each having an eccentric cam, a coupling means being formed by a trunnion pivotally connecting the cam followers.

The fifth embodiment of the invention which is shown in FIG. 5 essentially corresponds to that shown in FIG. 4 with the exception that the connection between the upper ends of the elbowed upper portions of the extensions 12 of cam followers 4 is established by a hinge formed by a pin 13 disposed in bores 13*a* formed in said upper ends. Thus, the extensions 12 are pivotally connected with one another by said pin 13 which forms the coupling element which allows a limited movement of the cam followers 4 with respect to one another if deficiencies of the above mentioned kind are present in the needle loom. Thereby, in operation jamming at the bearings of the eccentric shafts 2 is avoided, whereas the general orientation of the needle bards 5 is maintained.

Figure 6:
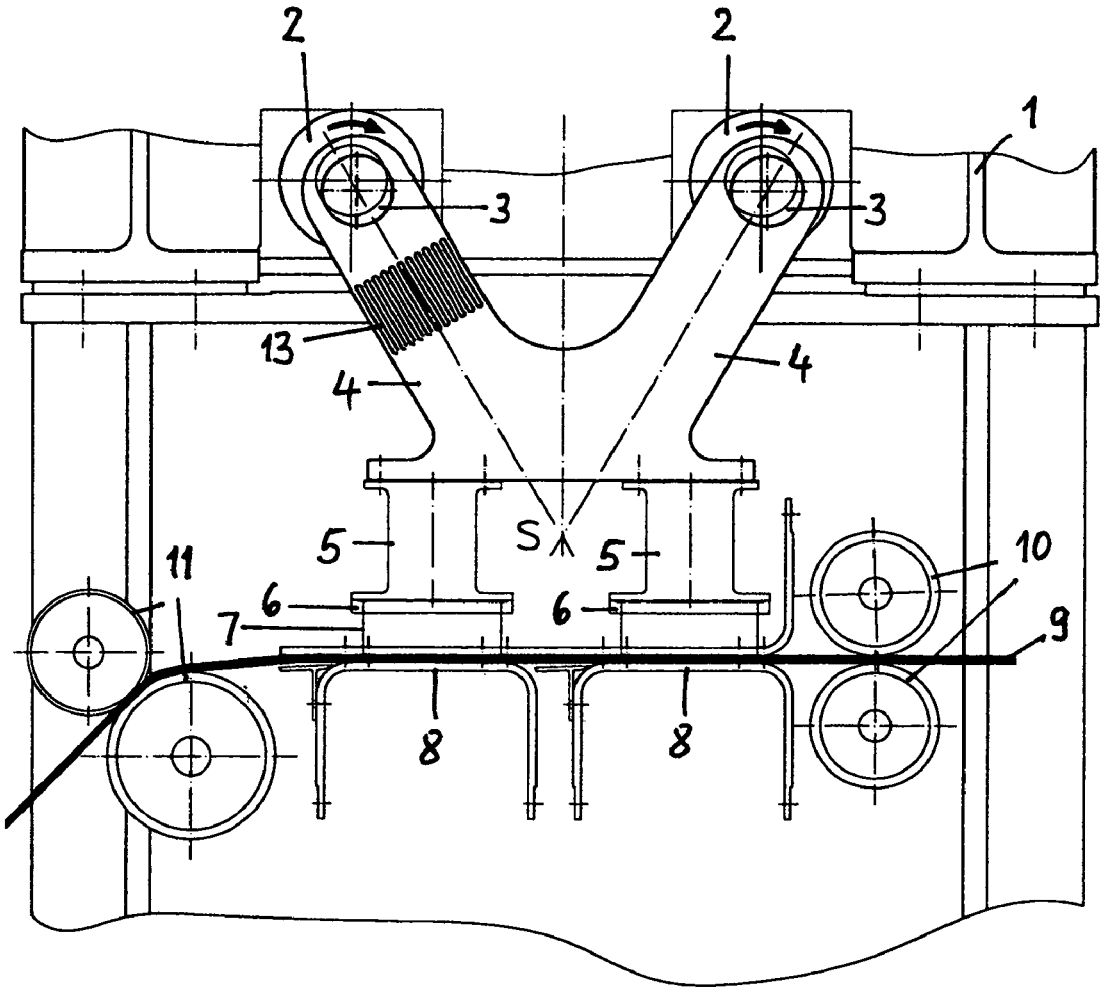
FIG. 6 is showing a sixth embodiment of the invention with a twin arrangement of rotating drive shafts each having an eccentric cam, with cam followers being rotatably supported on said eccentric cams and extending in an acute angle to one another, with a bendable coupling element being disposed in one of said cam followers.

In FIG. 6, a sixth embodiment of the invention is shown having cam followers 4 which extend in an acute angle to one another, said angle having an apex S directed to the stitching plates 8. In the region of said apex S, both cam followers are rigidly connected with one another, i.e. they form an integral unit. In the shown example, two needle bars 4 are mounted to the united cam followers 4 in the region of said apex S. This number, however, is not imperative, as the embodiment covers use of a single needle bar as well.

In one of the cam followers 4, in the drawing in the left hand cam follower, a coupling element 13 is disposed, which is stiff in longitudinal direction of the respective cam follower 4, but is resiliently flexible in a direction transverse thereto. In the shown embodiment, the coupling element 13 is provided by a plurality of slots which extend in parallel to one another in the longitudinal direction of said cam follower 4, so that the webs separating adjacent slots from one another render the respective cam follower yieldable in transverse direction. Thereby, the integral unit formed by both cam followers 4 is able to give way to lateral forces to a sufficient extent acting in a plane defined by the axes of the eccentric shafts 2. Thereby, in operation any jamming at the bearings of the eccentric shafts 2 can never appear.

The other elements of this embodiment are similar to those shown in the other drawings so that an explanation thereof is omitted.

Figure 7:
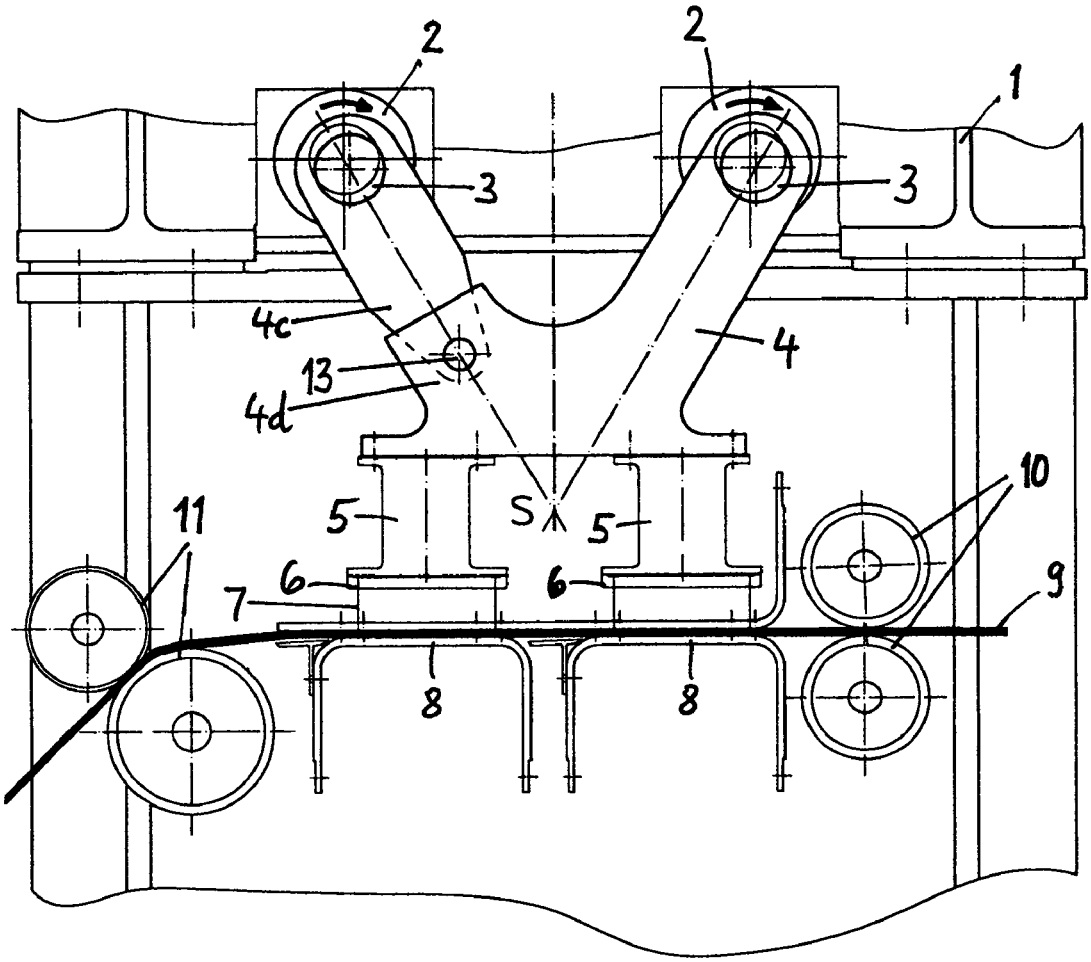
FIG. 7 is showing a sixth embodiment of the invention with a twin arrangement of rotating drive shafts each having an eccentric cam, with cam followers rotatably supported on said eccentric cams and extending in an acute angle to one another, with a shortened conrod being provided as one of the cam followers.

The seventh embodiment of the invention, which is shown in FIG. 7, is similar to that shown in FIG. 6, but differs therefrom in that the compliance of the cam follower structure is provided by the cam follower shown in the left portion of the drawing being formed by a shortened conrod 4*c* rotatably mounted at its one end on an eccentric cam 4 of the left hand eccentric shaft 2 and pivotally linked at its other end by a pin 13 to a pivot bracket 4*d* rigidly connected to the other cam follower 4. Thus, said pin 13 forms the coupling element. In operation, if the eccentric shafts 2 rotate but have some small deficiencies of the above mentioned kind, i.e. minute tolerances of deviations in the rotational phase angle of the eccentric cams 3, the structure formed by cam follower 4 and shortened conrod 4*c* is able to yield in horizontal direction in a plane defined by the rotational axes of the eccentric shafts 2, whereas the general orientation of the needle bars 5 affixed to the structure is maintained.

Figure 8:
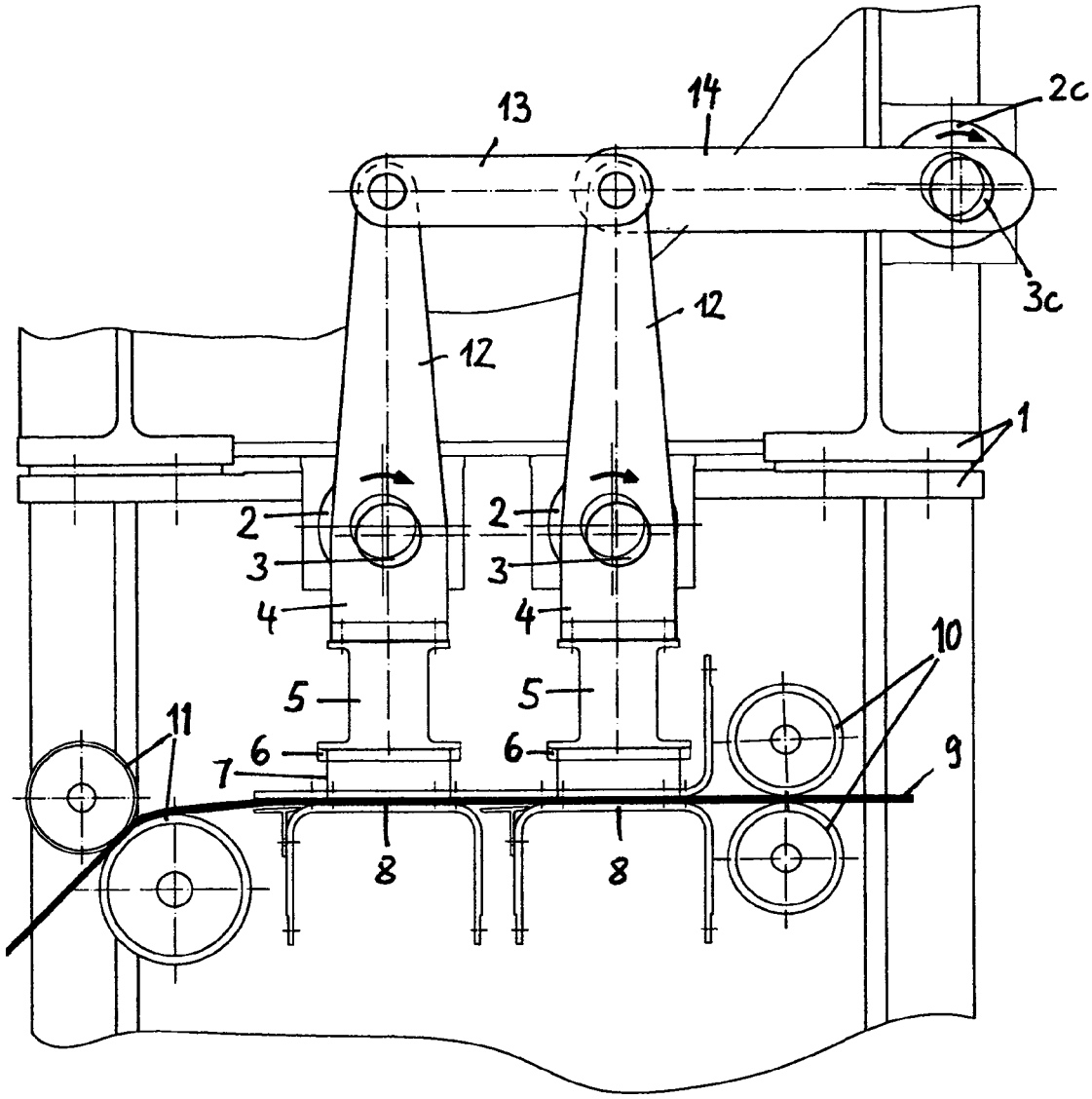
FIG. 8 is showing an eighth embodiment of the invention with a twin arrangement of rotating drive shafts and another drive shaft each having an eccentric cam, the eccentric cam of the latter being linked to the cam followers of the other cams by an articulated link arrangement.
Figure 9:
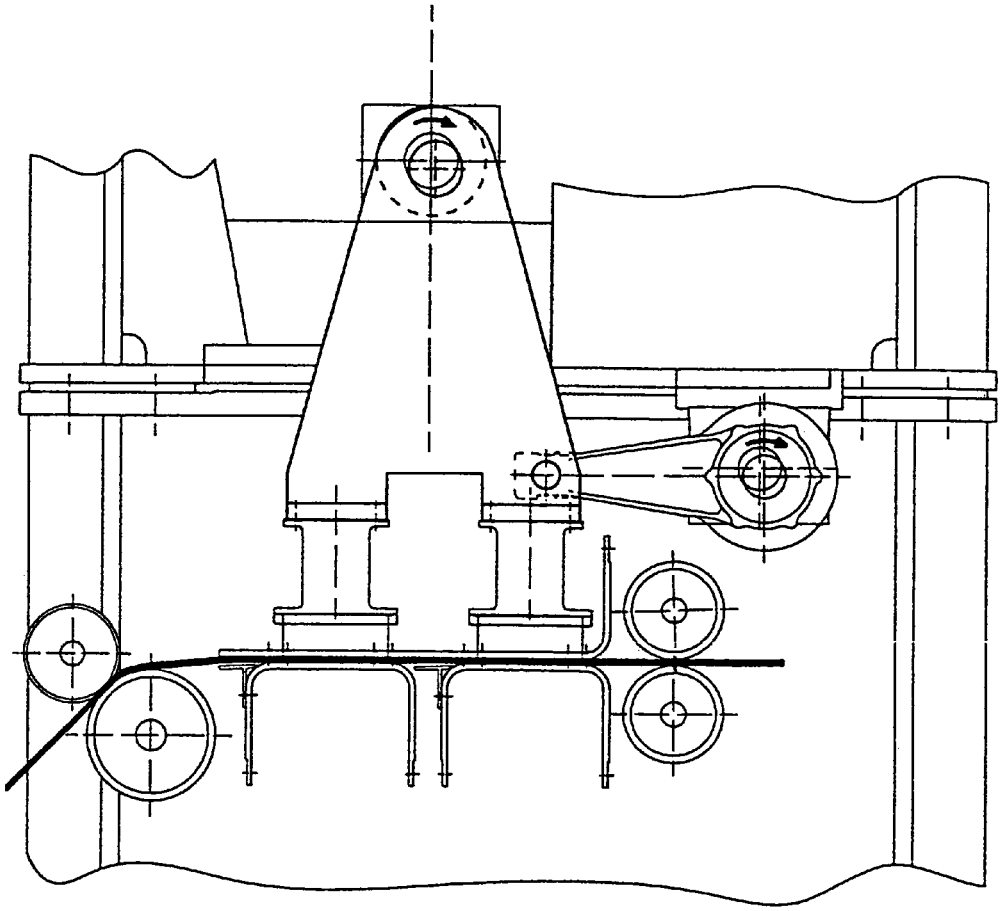
FIG. 9 (Prior Art)
FIG. 9 is showing a needle loom driving arrangement of the prior art.

The eighth embodiment of the invention shown in FIG. 8 differs from the other embodiments explained above in that the cam followers 4 having extensions 12 extending in parallel to one another and opposite with respect to the position of the needle bars 5 are linked to one another via a double hinge arrangement formed by a connecting bar 13 hingedly connected at its ends to the upper ends of said extensions 12. This structure affords a stabilization of the orientation of the needle bars 5, which is attained by a stabilizing bar 14 hingedly connected at one end to the upper end of one of the extensions 12 extending in prolongation of the connecting bar, said stabilizing bar being rotatably mounted at its other end on an eccentric cam 3*c* of a stabilizing eccentric shaft 2*c* mounted in the machine stand 1 in the same height level as the other eccentric shafts 2. The eccentric cam 3*c* has the same amount of eccentricity and the same angular position of revolution as the eccentric cams 3 of the other eccentric shafts 2.

Upon synchronous rotation of all eccentric shafts 2 and 2*b*, the connecting bar performs the same movement as the needle bars 5, however, a mutual pivotal movement of the cam followers 4 is allowed due to the double hinge arrangement, so that jamming at the bearings of the eccentric shafts 2 is avoided and the general orientation of the needle bars 5 is maintained. The driving power of the third eccentric shaft 2*c* is small as compared to the power which is necessary to cause the stitching movement of the needle bars 5, as the object of the third eccentric shaft 2*b* is not to move the needle bars 5 but merely to stabilize the orientation of the needle bars 5 via the stabilizing bar 14.

In a further embodiment of the invention which may be easily understood from FIG. 8, at least one further needle bar supported in the machine stand 1 and driven by an associated eccentric shaft having an eccentric cam of same eccentricity and angular position as the other eccentric cams may be stabilized by the same stabilization arrangement shown in FIG. 8 by connecting an extension of the cam follower of said further needle bar via another stabilizing link to one of the hinges of the stabilizing link 14 shown in the drawing.

The other elements of FIG. 8 correspond to respective elements in the other drawing having same reference numerals so that an explanation thereof may be omitted.

It is to be noted that in the actual design of a needle loom, the needle bars 5 are supported by the eccentric shafts 2 and the cam followers 4 at a plurality of locations which are spaced in longitudinal direction of the needle bars 5, wherein all cam followers 4 are designed in the manner as outlined by the present invention. Further, the invention is applicable as well in needle looms in which the needle bar(s) is or are disposed beneath the fiber web to be treated.

Further, the invention may also be applied at double needle looms in which the fiber web to be treated is needled from both of its sides. In this case, opposite needle bars may be operated with a 180° phase shift, so that their needles penetrate into the fiber web alternating from above and from below, so that the needle density at the needle boards may be maintained without any risk of needle collisions being created. However, it is also possible to operate a double needle loom in-phase of the needle bars. In the latter case, the needle density at the needle board is to be reduced accordingly to avoid collisions of needles penetrating the fiber web from both sides at a time.

The invention claimed is:

1. A needle loom having at least one needle bar coupled by cam and follower means to two eccentric shafts in order to be moved by said eccentric shafts in a movement path having two components which are normal to one another, wherein said eccentric shafts are each provided with eccentric cams which have equal amounts of eccentricity and equal angular positions of rotation and are adapted to be synchronously rotated, and cam followers each rotatably mounted on said eccentric cams are movably connected to one another by at least one coupling element which is adapted to yield in one direction but is stiff in a direction normal thereto.

2. The needle loom as set forth in claim 1 wherein a connection of said cam followers is established by at least one linking rod.

3. The needle loom as set forth in claim 1 wherein a connection of said cam followers is established by resilient metal spring means.

4. The needle loom as set forth in claim 3 wherein the cam followers are formed as an integral unit and the metal spring means are formed by providing said integral unit with a series of parallel slots extending through said integral unit.

5. The needle loom as set forth in claim 1, wherein said eccentric shafts are rotatably mounted in a common height level in a machine stand, said eccentric shafts each having one of the eccentric cams, on which the cam follower is rotatably mounted which supports the needle bar, wherein the coupling element is adapted to yield in a direction only which is normal to the eccentric shafts and is within a plane defined by said eccentric shafts, whereas the coupling element is stiff in a direction which is normal to said plane.

6. The needle loom as set forth in claim 5 wherein the cam followers are formed as an integral unit and the coupling element is formed therein as a series of parallel slots extending through said integral unit.

7. The needle loom as set forth in claim 1, wherein said eccentric shafts are rotatably mounted in a common height level in a machine stand, said eccentric shafts each having one of the eccentric cams, on which the cam follower is rotatably mounted which supports the needle bar, wherein the cam followers are connected to one another by two of the coupling elements, which are each fixed to both cam followers and are arranged so as to cross one another.

8. The needle loom as set forth in claim 7 wherein the coupling elements are rigidly connected to said cam followers and are flexible.

9. The needle loom as set forth in claim 7 wherein the coupling elements are disposed in an angle of 90° with respect to one another.

10. The needle loom as set forth in claim 9 wherein the coupling elements are rigidly connected to said cam followers and are flexible.

11. The needle loom as set forth in claim 9 wherein the coupling elements are fixed to extensions formed at said cam followers, said extensions extending opposite to the needle bars with respect to the eccentric shafts.

12. The needle loom as set forth in claim 7 wherein the coupling elements are fixed to extensions formed at said cam followers, said extensions extending opposite to the needle bars with respect to the eccentric shafts.

13. The needle loom as set forth in claim 1, wherein said eccentric shafts are rotatably mounted in a common height level in a machine stand, said eccentric shafts each having one of the eccentric cams, on which the cam follower is rotatably mounted which supports the needle bar, wherein the coupling element is a pin which is received by bores formed each in an extension of each cam follower, said extensions extending opposite to the needle bars with respect to the eccentric shafts.

14. The needle loom as set forth in claim 1, wherein said eccentric shafts are rotatably mounted in a common height level in a machine stand, said eccentric shafts each having one of the eccentric cams, on which the cam follower is rotatably mounted, wherein said cam followers extend in an acute angle with one another forming an apex, the cam followers being integrally united in a region of said apex and support at least one of the needle bars within said region, the coupling element being disposed in one of said cam followers between its associated eccentric shaft and said region where the cam followers are integrally united.

15. The needle loom as set forth in claim 14 wherein said coupling element is formed by a metal spring means, which is stiff in a longitudinal direction of its cam follower.

16. The needle loom as set forth in claim 15 wherein the cam followers are formed as an integral unit and the coupling element is formed therein as a series of parallel slots extending through said integral unit.

17. The needle loom as set forth in claim 14 wherein one of said cam followers is formed as a shortened conrod having one end which is rotatably supported on its associated eccentric cam and has a second end which is hingedly connected to a pivot bracket integrally formed at the other cam follower, and said coupling element is formed by a pin which pivotally connects said shortened conrod second end with said pivot bracket.

18. The needle loom as set forth in claim 1, wherein said eccentric shafts are rotatably mounted in a common height level in a machine stand, said eccentric shafts each having one of the eccentric cams, on which the cam follower is rotatably mounted, wherein the coupling element is a link rod having two ends which are hingedly connected to extensions of said cam followers extending opposite to the needle bars with respect to the eccentric shafts, and a third eccentric shaft is rotatably mounted in the machine stand and having a stabilizing eccentric cam of same amount of eccentricity and angular position of revolution as the eccentric cams of the first-mentioned eccentric shafts, wherein a stabilizing rod extending in the direction of said link rods is rotatably supported on said stabilizing eccentric cam and is hingedly connected to said link rod.

19. The needle loom as set forth in claim 1, wherein said eccentric shafts are rotatably mounted in different height levels and laterally offset with respect to one another in a machine stand, said eccentric shafts each having one of the eccentric cams, on which the cam follower is rotatably mounted, wherein the cam follower of said eccentric shaft mounted in the upper height level supports at least one of the needle bars and said coupling element disposed between the cam followers of both eccentric shafts is adapted to yield in a vertical direction only, whereas it is stiff in a horizontal direction.

20. The needle loom as set forth in claim 19 wherein the cam followers are formed as an integral unit and the coupling element is formed therein as a series of parallel slots extending through said integral unit.

21. A double needle loom having at least two needling assemblies disposed opposite to one another on opposite sides of a fiber web needling zone, wherein both needling assemblies comprise the needle loom of claim 1.

22. A double needle loom having at least two needling assemblies each comprising the needle loom of claim 1 and disposed opposite to one another on opposite sides of a fiber web needling zone, wherein in both needling assemblies a connection of said cam follower is established by at least one linking rod.

23. A double needle loom having at least two needling assemblies each comprising the needle loom of claim 1 and disposed opposite to one another on opposite sides of a fiber web needling zone, wherein in both needling assemblies a connection of said cam followers is established by resilient metal spring means.

24. A double needle loom having at least two needling assemblies each comprising the needle loom of claim 1 and disposed opposite to one another on opposite sides of a fiber web needling zone, wherein each of said needling assemblies comprises two of the eccentric shafts rotatably mounted in a common height level in a machine stand, said eccentric shafts each having the eccentric cam, on which the cam follower is rotatably mounted which supports the needle bar, wherein the coupling element is adapted to yield in a direction only which is normal to the eccentric shafts and is within a plane defined by said eccentric shafts, whereas the coupling element is stiff in a direction which is normal to said plane.

25. A double needle loom having at least two needling assemblies disposed opposite to one another on opposite sides of a fiber web needling zone, wherein both needling assemblies comprise the needle loom of claim 7.

* * * * *